US011807515B2

(12) United States Patent
Marchetto

(10) Patent No.: US 11,807,515 B2
(45) Date of Patent: Nov. 7, 2023

(54) FRAME FOR EQUESTRIAN SADDLE AND EQUESTRIAN SADDLE PROVIDED WITH THE SAME

(71) Applicant: EQUILINE S.R.L., Padua (IT)

(72) Inventor: Paolo Marchetto, Trebaseleghe (IT)

(73) Assignee: EQUILINE S.r.l., Padua (IT)

( * ) Notice: Subject to any disclaimer, the term of this patent is extended or adjusted under 35 U.S.C. 154(b) by 0 days.

(21) Appl. No.: 17/770,111

(22) PCT Filed: Oct. 21, 2020

(86) PCT No.: PCT/IB2020/059878
§ 371 (c)(1),
(2) Date: Apr. 19, 2022

(87) PCT Pub. No.: WO2021/094857
PCT Pub. Date: May 20, 2021

(65) Prior Publication Data

US 2022/0388834 A1 Dec. 8, 2022

(30) Foreign Application Priority Data

Nov. 11, 2019 (IT) ..... 102019000020769

(51) Int. Cl.
*B68C 1/10* (2006.01)

(52) U.S. Cl.
CPC ..... *B68C 1/10* (2013.01)

(58) Field of Classification Search
USPC ..... 54/44.4–44.6
See application file for complete search history.

(56) References Cited

U.S. PATENT DOCUMENTS 532,419 A * 1/1895 Haines, Jr. ..... B68C 1/02 54/66
3,323,286 A * 6/1967 Le Laurin, Jr. ..... B68C 1/025 D30/135

(Continued)

FOREIGN PATENT DOCUMENTS

DE 101 23 117 A1 11/2002
EP 3 501 957 A1 6/2019

(Continued)

OTHER PUBLICATIONS

Dec. 16, 2020 International Search Report issued in International Patent Application No. PCT/IB2020/059878.

(Continued)

*Primary Examiner* — Magdalena Topolski
*Assistant Examiner* — Morgan T Jordan
(74) *Attorney, Agent, or Firm* — Oliff PLC

(57) ABSTRACT

A frame for an equestrian saddle includes a frame body provided with at least one opening shaped corresponding at least partially to an inguinal and/or ischiatic and/or sacro-coccygeal region of a user. Each opening contains a shock-absorbing insert. The shock-absorbing insert includes a container provided with (i) one or more side walls and (ii) a bottom wall joined to the one or more side walls. The container defines an open top opposite to the bottom wall. At least one damping element is in the container on the bottom wall. The bottom wall is made with a first elastically deformable material, and the at least one damping element is made at least partially with a second at least partially elastically deformable material.

10 Claims, 2 Drawing Sheets

(56) References Cited

U.S. PATENT DOCUMENTS 3,343,338 A * 9/1967 Stubben ..... B68C 1/08 54/66
5,555,710 A * 9/1996 Smith ..... B68C 1/12 54/66
5,782,070 A * 7/1998 Knight ..... B68C 1/12 54/66
6,370,849 B1 * 4/2002 Merker ..... B68C 1/02 54/44.1
6,688,087 B2 * 2/2004 DeCosemo ..... B68C 1/02 54/44.1
11,225,407 B2 * 1/2022 Tobias, III ..... B68C 1/02
2002/0078666 A1 * 6/2002 Bates ..... B68C 1/08 54/44.1
2003/0177742 A1 * 9/2003 Brownlie ..... B68C 1/08 54/66
2004/0244340 A1 * 12/2004 Brownlie ..... B68C 1/08 54/66
2005/0086914 A1 * 4/2005 Fennelly ..... B68C 1/12 54/66
2006/0053755 A1 * 3/2006 Bates ..... B68C 1/04 54/44.6
2006/0080946 A1 * 4/2006 DeCosemo ..... B68C 1/02 54/44.1
2008/0134647 A1 * 6/2008 Dominique ..... B68C 1/025 54/44.1
2009/0205295 A1 * 8/2009 Odermatt ..... B68C 1/126 54/44.3
2009/0282790 A1 * 11/2009 Goblet ..... B68C 1/025 54/44.1
2011/0271651 A1 * 11/2011 Morgan ..... B68C 1/126 54/44.1
2012/0192531 A1 * 8/2012 Zabala-Goetschel ..... B68C 1/02 54/44.1
2013/0199136 A1 * 8/2013 Woods ..... B68C 1/00 54/44.1
2013/0318932 A1 * 12/2013 Israel ..... B68C 1/00 54/66
2014/0102052 A1 * 4/2014 Bates ..... B68C 1/04 54/44.3
2016/0145092 A1 * 5/2016 Marchetto ..... B68C 1/02 54/38.1
2017/0369301 A1 * 12/2017 Schleese ..... B68C 1/12

FOREIGN PATENT DOCUMENTS

GB 2 427 342 A 12/2006
WO 2014/207672 A1 12/2014

OTHER PUBLICATIONS

Dec. 16, 2020 Written Opinion of the International Searching Authority issued in International Patent Application No. PCT/IB2020/059878.

* cited by examiner

FRAME FOR EQUESTRIAN SADDLE AND EQUESTRIAN SADDLE PROVIDED WITH THE SAME

TECHNICAL FIELD OF THE INVENTION

The present invention relates to a frame for an equestrian saddle and to an equestrian saddle provided with the same.

BACKGROUND OF THE INVENTION

In the prior art, equestrian saddles designed to be positioned on the back of an equine, such as a horse or the like, so as to allow a user to sit thereon preferably astride the animal, are known.

Equestrian saddles comprise a frame, generally rigid, and a covering element, generally soft, adapted to cover the frame so as to define a seating portion at contact with the base of the user's back. Furthermore, the equestrian saddles may comprise any additional accessory elements configured to increase the functionality thereof. As known in the prior art, examples of possible further accessory elements are a protection element which is interposed between the frame and the back of the animal, and/or flaps and under-flaps suitable to prevent the direct contact of the legs of the user with the sides of the animal, and/or lashes, and the like.

The equestrian saddle and the frame thereof are designed to maintain a correct posture of the user and to at least partially absorb the stresses transmitted in the conditions of use, thus increasing the comfort both for the user and for the animal.

Therefore, equestrian saddles generally provide for devices configured to dampen the vertical stresses the user is subjected to at the areas of contact with the seating portion of the saddle.

These devices typically comprise elements made with damping materials, such as foam rubber or the like, which are arranged in suitable areas of the frame of the equestrian saddle.

For example, patent document WO2014207672A1 describes a frame for an equestrian saddle comprising recesses, i.e. cavities, adapted to receive respective shock-absorbing inserts made of an at least partially elastically deformable material. In this condition, the damping effect is provided by the absorption of impacts and vibrations by means of the shock-absorbing insert, i.e. by means of the material it is made of.

Although this solution allows a damping of the stresses that the user is subjected to, it however reveals some drawbacks.

As a matter of fact, the degree of absorption of impacts and vibrations by means of the shock-absorbing insert is limited by the thickness of the latter. Furthermore, since the shock-absorbing insert rests on the rigid bottom of the recess formed on the frame, the degree of absorption of the impacts and vibrations by means of the shock-absorbing insert is influenced by the presence of the recess bottom. In other words, the characteristics of the material that the shock-absorbing insert is made of and which ensure the absorption of impacts and vibrations, such as for example hardness and/or degree of elasticity, are substantially influenced by the presence of the rigid bottom of the recess in which it is received.

This drawback could be solved, for example, by increasing the thickness of the shock-absorbing insert, so as to reduce or render the influence of the rigid bottom negligible.

However, in this condition functional characteristics of the saddle, such as for example compactness and/or lightness, are deteriorated.

Patent document DE10123117A1, on the other hand, describes a frame for an equestrian saddle comprising a through opening adapted to receive a respective shock-absorbing insert made of a flexible material. Even in this case, the damping effect is provided by the absorption of impacts and vibrations by means of the shock-absorbing insert, or by means of the material that it is made of. However, the structure of this frame is complicated, especially during the manufacturing step, and it does not ensure a constant quality and reliability of the product. Furthermore, such structure does not allow a simple possible replacement of the elements that provide the equestrian saddle with the damping effect.

Thus, there is the need to provide a solution which overcomes the drawbacks described above.

SUMMARY OF THE INVENTION

The task of the present invention is to provide a frame for an equestrian saddle capable of providing an effective absorption of impacts and vibrations by means of shock-absorbing inserts, that is simple to produce, and which ensures a constant quality and reliability of the product.

Within the scope of the aforementioned task, an object of the present invention relates to providing of a frame provided with shock-absorbing inserts in which the degree of absorption of impacts and vibrations is not limited by the thickness of the latter.

A further object relates to providing a frame in which the characteristics of the material of the shock-absorbing insert, which ensure the absorption of impacts and vibrations, are not influenced by the shape of the frame portion in which the shock-absorbing insert is received.

A further object relates to providing a frame in which the characteristics of the shock-absorbing insert which ensure the absorption of impacts and vibrations are easily and widely selectable during the design stage.

A further object relates to providing a frame in which the shock-absorbing insert can be made of materials whose characteristics may be widely selectable and/or easily combined with each other.

A further object relates to providing a frame in which the shock-absorbing inserts have a simple structure, can be coupled in a simple and effective manner with the other elements that constitute the frame, and ensure a constant quality and reliability of the product.

The aforementioned task and objects, as well as others which will be more apparent from the following description, are achieved by means of a frame for an equestrian saddle as defined in claim 1.

BRIEF DESCRIPTION OF THE FIGURES

The further characteristics and advantages of the frame for an equestrian saddle according to the present invention will become more evident in the following description relating to an embodiment provided purely by way of non-limiting example, with reference to the following figures wherein.

DETAILED DESCRIPTION OF THE INVENTION

An equestrian saddle is designed to be positioned on the back of an equine, such as a horse or the like, so as to allow a user to sit preferably astride the animal taking a correct and comfortable posture. As known, various types of equestrian saddles designed for a plurality of disciplines are available on the market. For example, an equestrian saddle can be suitable for English or American riding styles for different disciplines such as hurdling, dressage, trekking, polo, or the like.

The equestrian saddles comprise a substantially rigid frame and a substantially soft covering element adapted to cover the frame so as to define a seating portion at contact with the base of the back of the user. Furthermore, as known, the equestrian saddles may comprise possible further accessory elements configured to increase the functionality and/or comfort of the saddle, such as a protection element which is interposed between the frame and the back of the animal, and/or flaps and under-flaps, and/or lashes, and the like.

Figure 1:
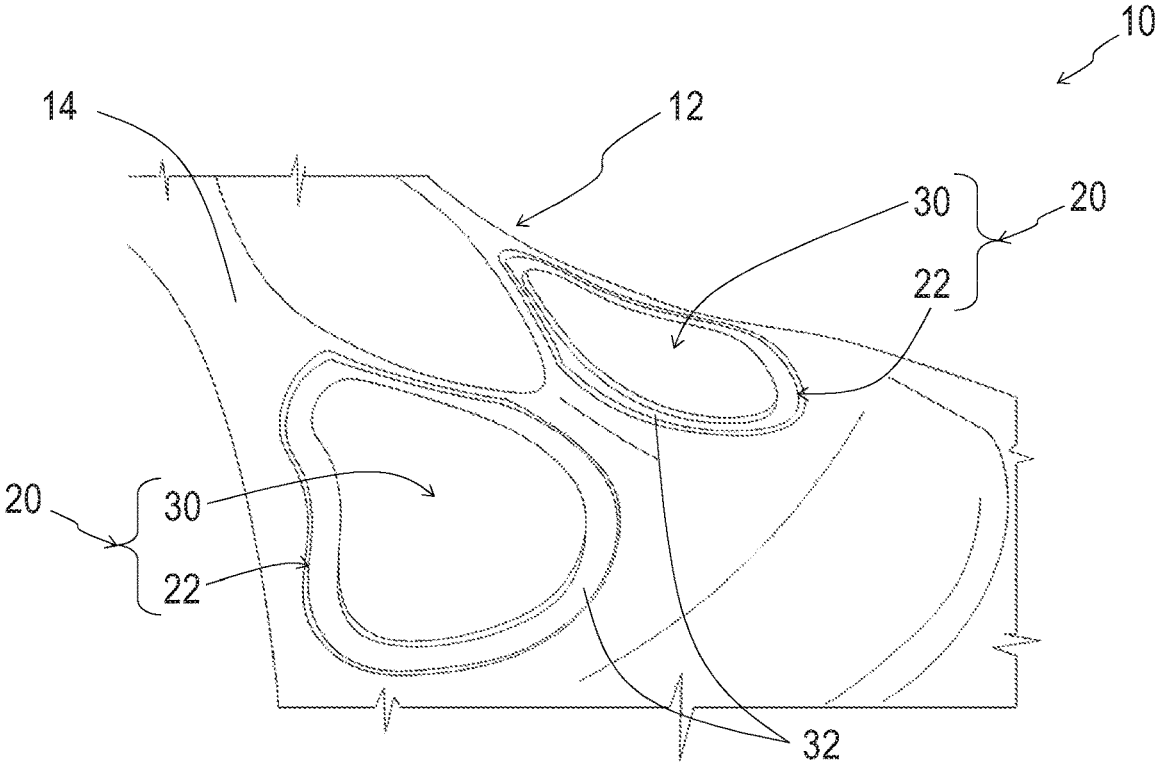
FIG. 1 is a first partial perspective view of a frame for an equestrian saddle, according to a preferred embodiment of the present invention.
Figure 2:
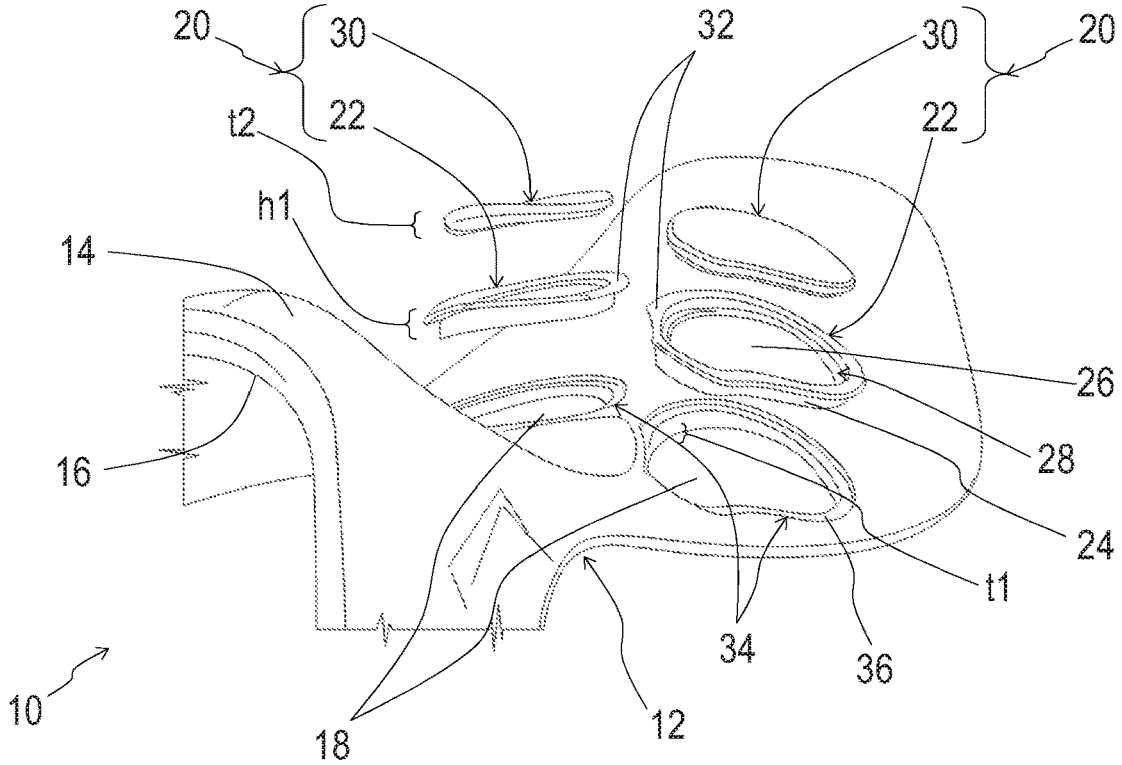
FIG. 2 is a second exploded perspective view of the frame of FIG. 1.
Figure 3:
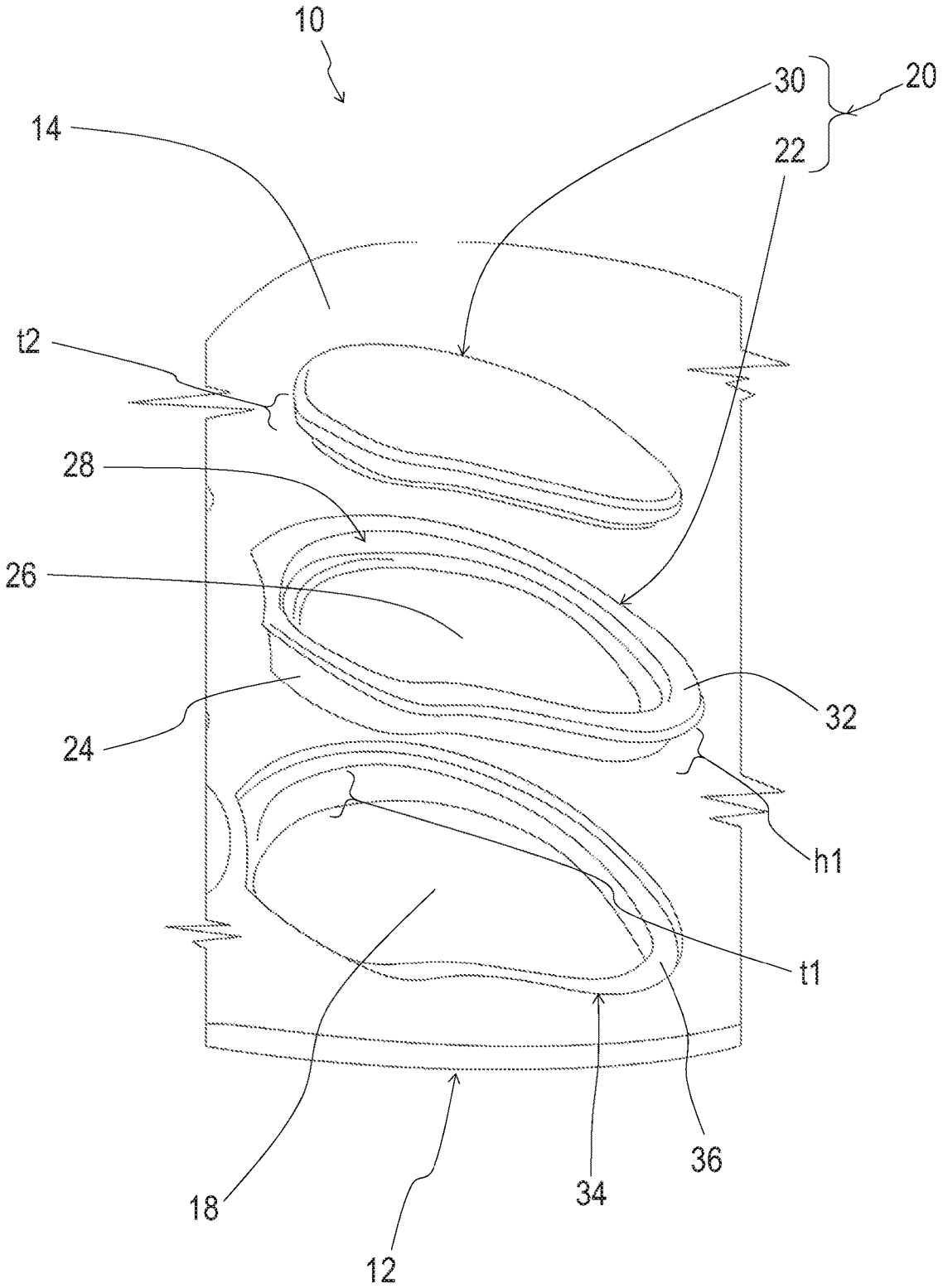
FIG. 3 is an enlarged view of a portion of the frame of FIG. 2.

With reference to FIGS. 1 to 3, a frame 10 of an equestrian saddle in a preferred embodiment of the present invention is shown. In the present description and in the attached figures, the covering element of the frame 10 and the possible further accessory elements of an equestrian saddle will not be described and shown. However, to a skilled person it will be clear that the present disclosure can be used for providing of a frame 10 for any type of equestrian saddle suitable for each of the different disciplines.

The frame 10 comprises a substantially rigid frame body 12 which is made of a material suitably selected as a function of the application of the equestrian saddle, such as for example wood, metal, polymeric material possibly reinforced with fibres, or combinations thereof. The frame body 12 has a first upper surface 14 adapted to be operatively faced toward a user and a second lower surface 16 adapted to be operatively faced toward the back of an equine. The first surface 14 and the second surface 16 of the frame body 12 are separated from each other by a first thickness t1 of the frame body 12.

Typically, a covering element (not shown in the figures) which is generally soft and which further defines a seating portion at contact with the base of the back of the user is arranged on the first surface 14. Whereas, the second surface 16 is typically at contact with the back of the animal or provides for a protection element, such as a layer of soft material, which is interposed between the frame body 12 and the back of the animal so as to increase the comfort for the latter. However, these configurations of the first surface 14 and the second surface 16 are not limiting and further elements, such as for example a plurality of covering elements and/or protection elements, or the like, may be provided for.

The frame body 12 comprises a larger rear extension portion defining the panel portion, a front portion proximal to the head of the animal defining the fork portion, and an intermediate connecting portion between the other two and having the smaller width between the three portions. The frame body 12 is generally shaped so that in the front, rear and intermediate portions thereof there are areas adapted to support the base of the back of the user at the inguinal, ischial and sacrococcygeal region.

Specifically, in the preferred embodiment of the present invention, the frame body 12 provides for, at the ischial region, two openings 18 substantially symmetrical to each other with respect to a longitudinal axis of the frame body 12. The openings 18 preferably have a circular lobed shape and they are shaped, for example, by removing material from the frame body 12 using cutting or milling techniques. Alternatively, the frame body 12 is formed already provided with openings 18 which are obtained by means of a single forming step, such as for example moulding. In the most preferred embodiment, the openings 18 are through openings between the first surface 14 and the second surface 16, i.e. they are openings that pass through the first thickness t1 of the frame body 12.

Each opening 18 is adapted to receive—therein—a respective shock-absorbing insert 20 which is configured to dampen impacts and/or vibrations suffered, or perceived, by the user. Typically, impacts and vibrations are exerted under operating conditions along a vertical direction that is substantially perpendicular to the first surface 14 of the frame body 12.

Referring in particular to FIGS. 2 and 3, in the present invention each shock-absorbing insert 20 comprises a container 22 and a damping element 30. Each container 22 is formed distinct from the frame body 12 and it is adapted to receive the respective damping element 30.

The container 22 provides for one or more side walls 24 and a bottom wall 26 which are joined to each other defining an open base 28 opposite the bottom wall 26. The open base 28 and the bottom wall 26 are separated from each other by a height h1 of the container 22 which is substantially defined by the vertical extension of the side walls 24. Furthermore, the container 22 is configured to be received in the respective opening 18 so as to associate, in operative conditions, the open base 28 thereof with the first surface 14 of the frame body 12, or so as to direct the open base 28 thereof substantially at the first surface 14 of the frame body 12. In the preferred embodiment, the container 22 is configured to be received in the respective opening 18 so as to arrange—in operative conditions—the open base 28 thereof substantially flush with the first surface 14 of the frame body 12.

The damping element 30, on the other hand, is preferably formed distinct from the container 22 and is adapted to be received in the latter on the bottom wall 26 thereof. In the preferred embodiment, the damping element 30 has a shape corresponding to that of the bottom wall 26 and it has a second thickness t2 suitably dimensioned so that, in operative conditions, the damping element 30 is flush with the first surface 14 of the frame body 12, i.e. flush with the open base 28 of the container 22.

Specifically, in the present invention, the bottom wall 26 of the container 22 is made of a first elastically deformable material configured to dampen impacts and/or vibrations, in the operative conditions, and the damping element 30 is made at least partially with a second at least partially elastically deformable material configured to dampen impacts and/or vibrations in the operative conditions.

As used herein, the term "at least partially elastically deformable material" comprises both materials having elastic properties (elastic materials) and materials having viscoelastic properties (viscoelastic materials). Specifically, a material having elastic properties is configured to be deformed, when—in operative conditions—a stress such as an impact and/or vibration is applied thereon, and subsequently rapidly recover the initial shape at the end of the application of the stress. On the other hand, materials that have viscoelastic properties simultaneously have viscous and elastic properties, in a given relationship with respect to each other. In other words, without wishing to be bound by theory, when materials having viscoelastic properties are subjected to a stress applied very rapidly, they are subjected a deformation proportional to the stress and provide for recovery if the stress is removed very rapidly. If the stress is applied slowly or for a long period of time, materials having viscoelastic properties behave to a certain degree as a viscous liquid providing continuous deformation over time and in which the degree of deformation is proportional to the applied stress. Thus, an elastomeric polymeric material such as, for example, a thermoplastic elastomer or a thermosetting elastomer have substantially elastic properties and thus they are elastically deformable materials; instead, a gel or a slow shape memory material have substantially viscoelastic properties and therefore they are at least partially elastically deformable materials.

The first material of the bottom wall 26 and the second material of the damping element 30 may be selected from a group comprising polymeric materials. Specifically, the first and second material are selected so as to provide the shock-absorbing insert 20 with desired characteristics, such as adequate mechanical strength for supporting the weight of the user and adequate elastic/viscoelastic properties to dampen impacts and/or vibrations. Advantageously, in this condition it is possible to combine different characteristics of the first and of the second material with each other.

In the preferred embodiment, the first material of the bottom wall 26 is an elastomeric polymeric material, preferably thermoplastic, such as for example soft thermoplastic polyurethane (TPU), and the second material of the damping element 30 is a gel.

In this condition, advantageously the damping element 30 is made of a material having excellent damping characteristics thanks to its viscoelastic properties but poor mechanical strength characteristics, and at the same time the bottom wall 26 is made of a material having good damping characteristics and excellent mechanical strength characteristics for, for example, supporting the weight of the user and the durability at multiple deformation steps.

Specifically, the soft thermoplastic polyurethane (TPU) provides for characteristics such as preferably a tensile modulus of elasticity lower than 600 MPa (ISO 527) and a hardness comprised between 15 ShoreA and 80 ShoreD (ISO 7619), and the gel provides for characteristics such as preferably a hardness lower than 20 ShoreA (ISO 7619), even more preferably a hardness from 40 to 60 VLRH (ISO 27588). However, this selection is non-limiting and the first material and the second material can be widely and suitably selected. In other words, according to the present invention, it is advantageously possible to widely choose the damping characteristics of the second material even when it provides for poor mechanical strength characteristics since the latter are possibly compensated by the mechanical resistance characteristics of the first material.

Furthermore, advantageously, thanks to the structure of the frame 10 according to the present invention the degree of absorption of impacts and vibrations by the shock-absorbing insert 20 is not limited by the thickness thereof and by the configuration of the portion of the frame 10 in which it is received. As a matter of fact, the bottom wall 26 can be freely deformed, possibly beyond the first thickness t1 of the frame body 12, at the respective opening 18, i.e. it can be deformed beyond the second surface 16 of the frame body 12.

In the preferred embodiment, the container 22 has a configuration suitable to be received in the respective opening 18 by means of shape coupling, i.e. it has a shape complementary to that of the respective opening 18. Thus, in the preferred embodiment, wherein the openings 18 have a lobed circular shape, the respective containers 22 each provide for a bottom 26 having a shape substantially complementary to that of the respective opening 18 and from which a single side wall 24 departs defining the open base 28.

However, this embodiment is not limiting and each opening 18 can have any desired shape, as a function of the corresponding anatomical area of the user that it supports, and the respective container 22 can have one or more side walls joined to the bottom wall 26, depending on the shape of the latter.

Once again referring in particular to FIGS. 2 and 3, in the preferred embodiment the container 22 is provided with a flanged portion 32 extending from the side wall 24 of the container 22. In the most preferred embodiment, the flanged portion 32 extends from the free end of the side wall 24 defining the open base 28 of the container 22.

Specifically, the flanged portion 32 extends along a direction at least partially parallel to the first surface 14 of the frame body 12 and it is configured to abut against a rim portion 34 peripheral to the opening 18 of the frame body 12 when the latter receives the respective container 22 of the shock-absorbing insert 20. In the preferred embodiment, the flanged portion 32 and the side wall 24 from which they depart are formed in single piece with each other with a third substantially rigid material. Alternatively, the side wall 24, made of a third substantially rigid material, and the flanged portion 32, made of a fourth substantially rigid material, can be formed distinct and subsequently joined together for example by welding, adhesive means, fixing elements or the like.

The third side wall material 24 may be selected from a group comprising substantially rigid polymeric materials. Specifically, the third material is selected so as to provide the container 22 with desired characteristics, such as an adequate structural stability adapted to ensure that the position of the shock-absorbing insert 20 in the respective opening 18 is maintained in operative conditions.

In the preferred embodiment, the third material of the side wall 24 is a polymeric material, preferably thermoplastic, such as for example rigid thermoplastic polyurethane (TPU) or polypropylene (PP).

For example, the rigid thermoplastic polyurethane (TPU), optionally reinforced with fibres or the like, has characteristics such as preferably a flexural elastic modulus comprised between 1000 and 2500 MPa (ISO 178), or the polypropylene (PP) provides for characteristics such as preferably a flexural elastic modulus of between 1000 and 1500 MPa (ISO 178). However, this selection is non-limiting and the third material may be widely and suitably selected.

In the preferred embodiment, the side wall 24 and the bottom wall 26 of the container 22 are joined to each other by over-moulding, bi-injection moulding or welding. Therefore, in this case, the first material of the bottom wall 26 and the third material of the side wall 24 are selected depending on the chemical nature thereof so as to ensure the joining thereof by means of overmoulding, bi-injection moulding or welding.

Furthermore, once again referring in particular to FIGS. 2 and 3, in the preferred embodiment the frame body 12 comprises, at the rim portion 34 of each opening 18, an abutment step 36 forming a reduction of the first thickness t1 of the frame body 12. The abutment step 36 is configured to receive the flanged portion 32 of the container 22 so as to arrange—in operative conditions—the open base 28 and the flanged portion 32 of the container 22 substantially flush with the first surface 14 of the frame body 12.

Advantageously, this condition allows to prevent the formation of a projection on the first surface 14 of the frame body 12, due to the flanged portion 32, which could deteriorate the comfort of the user. Furthermore, the abutment step 36 advantageously acts as a seat adapted to facilitate and maintain the positioning of the shock-absorbing insert 20, i.e. of the container 22, in the opening 18.

In the preferred embodiment, the container 22 has a height h1, i.e. a distance between the bottom wall 26 thereof and the open base 28 thereof, which is equal to or slightly greater than the first thickness t1 of the frame body 12 at the respective opening 18 which houses it. Furthermore, as mentioned previously, the damping element 30 preferably has a second thickness t2 suitably dimensioned so that, in operative conditions, the damping element 30 is flush with the open base 28 of the container 22, i.e. it is flush with the first surface 14 of the frame body 12.

Advantageously, this condition allows to prevent the formation of a projection on the first surface 14 of the frame body 12, due to the damping element 30, which could deteriorate the comfort of the user.

Furthermore, since the container 22 has a height h1 substantially equal to or slightly greater than the first thickness t1 of the frame body 12, advantageously a constant thickness of the frame 10 is maintained, i.e. the compactness thereof is maintained. In other words, a first thickness t1 of the relatively small frame body 12 does not limit the degree of absorption of impacts and vibrations by the shock-absorbing insert 20 since the bottom wall 26 of the container 22 can be freely deformed, possibly beyond the first thickness t1 of the frame body 12, i.e. beyond the second surface 16 of the frame body 12.

It is clear that further embodiments of the frame 10 for the equestrian saddle can be provided with respect to what has been described so far, without departing from the claimed scope of protection.

For example, in the embodiment described above, the frame body 12 provides for, at the ischial region, two openings 18 which are substantially symmetrical to each other with respect to a longitudinal axis of the frame body 12; however, this embodiment is not limiting. As a matter of fact, an embodiment in which there is a single opening 18 symmetrical with respect to the longitudinal axis of the frame body 12 and shaped at the ischial region, may be provided for.

Alternatively, further embodiments in which one or more openings 18 are shaped at least partially corresponding to the inguinal and/or ischial and/or sacrococcygeal region of the user may be provided for depending on the design of the equestrian saddle and as a function of the application thereof. Specifically, each opening 18 is adapted to receive a respective shock-absorbing insert 20 having the characteristics according to the present invention, and described previously.

Furthermore, in the embodiment described above, the container 22 simply abuts, through the flanged portion 32 thereof, on the abutment step 36 of the rim portion 34 of the respective opening 18. This advantageous simple structure allows to maintain the positioning of the shock-absorbing insert 20, i.e. of the container 22, in the opening 18 since the first surface 14 of the frame 12 is typically covered with a covering element (not shown in the figures) which further ensures that the position of the shock-absorbing insert 20 is maintained, holding it. However, an embodiment in which the container 22 does not provide for a flanged portion 32 but is provided with fixing elements, such as screws or coupling portions, or adhesive means suitable for fixing, such as for example, the side wall 24 of the container 22 to the frame body 12, may be provided for. Alternatively, an embodiment in which the container 22 provides both a flanged portion 32 and fixing elements or adhesive means to further ensure the position of the shock-absorbing insert 20 in the opening 18 may be provided for.

Furthermore, in the embodiment described above, the container 22 provides for a single flanged portion 32 which extends continuously from the side wall 24. However, an embodiment in which the flanged portion 32 consists of a plurality of projecting portions distributed along the side wall 24 and which are adapted to abut against a corresponding plurality of abutment steps 36 of the rim portion 34 of the respective opening 18, may be provided for.

Furthermore, in the embodiment described above, the container 22 provides for a flanged portion 32 which is configured to abut against a rim portion 34 peripheral to the opening 18 of the frame body 12. However, an embodiment in which a flanged portion 32 extends from the thickness wall of the frame body 12 defining the opening 18, along a direction at least partially parallel to the first surface 14, may be provided for. Specifically, in this embodiment, the flanged portion 32 is configured to abut against a rim portion 34 peripheral to the bottom wall 26 of the container 22.

Furthermore, in the embodiment described above, the container 22 provides for an open base 28 opposite the bottom wall 26. However, an embodiment in which the container 22 further comprises a lid configured to close, preferably removably, the open base 28, may be provided for. In this embodiment, the cover is made of an elastically deformable material configured to dampen impacts and/or vibrations, such as the bottom wall 26, or an at least partially elastically deformable material configured to dampen impacts and/or vibrations, such as the damping element 30.

Furthermore, in the embodiment described above, each opening 18 is a through opening between the first surface 14 and the second surface 16, i.e. an opening that passes through the first thickness t1 of the frame body 12. However, an embodiment in which the opening 18 is a recess, i.e. a cavity or blind opening, having a depth less than the first thickness t1 and greater than the height h1 of the container 22, may be provided for. Specifically, in this embodiment the container 22 is configured to be housed in the respective blind opening 18 so as to arrange the bottom wall 26 thereof spaced from the bottom of the blind opening 18. A free deformation of the bottom wall 26 of the container 22 may be ensured in this condition, like in the embodiment described above, but it is necessary to provide relatively high values of the first thickness t1 of the frame body 12.

Furthermore, in the embodiment described above, the damping element 30 is a single element formed distinct from the container 22 and suitable to be housed in the latter on the bottom wall 26. However, an embodiment in which each shock-absorbing insert 20 comprises a plurality of damping elements 30 adapted to be housed in the container 22 on the bottom wall 26, may be provided for. Specifically, an embodiment in which two or more damping elements 30 are arranged stacked or side by side, providing a differential damping effect in different areas of the shock-absorbing insert 20, may be provided for.

Furthermore, an embodiment in which the damping element 30 is joined, for example by means of adhesive means, to the bottom wall 26 of the container 22 or it is formed in single piece or integral with the bottom wall 26 of the container 22, may be provided for. In the latter case, preferably the first material of the bottom wall 26 and the second material of the damping element 30 are the same material.

Furthermore, in the embodiment described above, the first material of the bottom wall 26 is soft thermoplastic polyurethane (TPU), and the second material of the damping element 30 is a gel; however, this selection is non-limiting. As a matter of fact, the first material and the second material may be suitably selected from a group comprising elastomeric polymeric materials of the thermoplastic or thermosetting type, or natural elastomeric polymeric materials. For example, the first material and the second material may be selected from a group comprising elastomeric polymeric materials of the thermoplastic type, such as thermoplastic polyurethane (TPU), polyolefin elastomers (POEs), styrene elastomers (SBS, SEBS) or the like, and/or they may be selected from a group comprising elastomeric polymeric materials of the thermosetting type, such as for example silicone or the like, and/or they may be selected from a group comprising natural elastomeric polymeric materials, such as for example natural rubber (NR) or the like. Possibly, the first material and the second material may be materials having the same chemical nature, such as for example soft thermoplastic polyurethane (TPU), but having different characteristics, such as for example a different hardness and a different degree of elasticity.

Alternatively, the second material of the damping element 30 may be a shape memory material suitable for recovering an initial shape at the end of a stress. Furthermore, the first material of the bottom wall 26 may be a material selected from a group comprising natural materials, such as leather, or from a group comprising synthetic materials imitating natural materials, such as artificial leather.

Furthermore, an embodiment in which the damping element 30 comprises a closable bag, made of an elastically deformable material, and containing therein a viscous material, such as a fluid or a liquid with a given viscosity, for example, water or a substance/composition having low or high viscosity, may be provided for. In this condition, the damping element 30 has viscoelastic properties and it is at least partially made of an at least partially elastically deformable material.

Furthermore, in the embodiment described above, the third material of the side wall 24 is a rigid thermoplastic polyurethane (TPU) or polypropylene (PP); however, this selection is non-limiting. As a matter of fact, the third material may be suitably selected from a group comprising thermoplastic or thermosetting polymeric materials, metallic materials, or natural materials. For example, the third material may be selected from a group comprising thermoplastic polymeric materials, such as polypropylene (PP), polyamide (PA6, PA66, PPA), acrylonitrile-butadiene-styrene (ABS), polycarbonate (PC) or the like, and/or it may be selected from a group comprising thermosetting polymeric materials, such as epoxy resins or the like, and/or it may be selected from a group comprising metals, such as aluminium or the like, and/or it may be selected from a group comprising natural materials, such as wood or the like.

It is clear that, depending on the selection of the first material and the third material, the bottom wall 26 and the side wall 24 are joined to each other forming the container 22 by means of suitable solutions, such as for example adhesive means, fixing elements, welding, overmoulding, bi-injection moulding, or the like.

In the light of the above description, it is clear that significant results have been achieved, overcoming the drawbacks of the prior art, allowing to provide a frame 10 which provides an effective absorption of impacts and vibrations by means of the shock-absorbing inserts 20, whose structure is simple to manufacture and it ensures constant quality and reliability of the product.

Furthermore, the degree of absorption of impacts and vibrations by the shock-absorbing inserts 20 is not limited by the thickness thereof since the combination of the characteristics of the first material of the bottom wall 26 and of the second material of the damping element 30 guarantee an effective damping effect even at reduced values of the second thickness t2 of the damping element 30 and of the height h1 of the container 22.

Furthermore, the degree of absorption of impacts and vibrations by the shock-absorbing inserts 20 is not influenced by the configuration of the respective opening 18 which, on the contrary, in the present invention allows a free deformation of the bottom wall 26 of the container 22.

Furthermore, the materials that the bottom wall 26 of the container 22 and the damping element 30 are made of may be easily and widely selected to confer the shock-absorbing insert 20 suitable desired characteristics such as an adequate mechanical strength for supporting the weight of the user and suitable elastic/viscoelastic properties for damping impacts and/or vibrations. Specifically, different characteristics of the first and of the second material, respectively, of the bottom wall 26 and of the damping element 30 may be combined to each other.

Lastly, the frame 10 has a simple structure, it is easy to manufacture and it ensures a constant quality and reliability of the product. Specifically, the shock-absorbing inserts 20 have a simple structure and they can be coupled in a simple and effective manner with the frame body 12 maintaining a constant quality and reliability of the product. Possibly, the shock-absorbing inserts 20 may be replaced in a simple manner, for example for maintenance of the frame 10, maintaining the reliability of the product.

Naturally, the materials and equipment used to implement the present invention, as well as the shape and dimensions of the individual components, may be the most suitable depending on the specific requirements.

The invention claimed is:

1. A frame for an equestrian saddle, the frame comprising:

a frame body provided with an upper surface adapted to be operatively directed towards a user and a lower surface adapted to be operatively directed towards an equine's back, the frame body including at least one opening shaped corresponding at least partially to an inguinal region and/or ischial region and/or sacrococcygeal region of the user; and at least one shock-absorbing insert, each of the at least one shock-absorbing insert being received in a respective one of the at least one opening, each shock-absorbing insert comprising:

a container provided with (i) one or more side walls and ii) a bottom wall joined to the one or more side walls, the container defining an open top opposite to the bottom wall, the container being formed distinct from the frame body and being received in the respective at least one opening such that the open top is toward the upper surface, and at least one damping element inside the container on the bottom wall, wherein the bottom wall is made with a first elastically deformable material configured to dampen impacts and/or vibrations, wherein the at least one damping element is made at least partially with a second at least partially elastically deformable material configured to dampen impacts and/or vibrations, and wherein the one or more side walls are made with a third rigid material, the third rigid material being distinct from the first elastically deformable material and the second at least partially elastically deformable material.

2. The frame according to claim 1, wherein one of (i) the at least one opening of the frame body and (ii) the respective container is provided with a flanged portion which extends along a direction at least partially parallel to the upper surface, the flanged portion being configured to abut against a rim portion which is peripheral to the other of (i) the at least one opening at the upper surface and (ii) the respective container at the bottom wall, when the at least one opening receives the respective at least one shock-absorbing insert.

3. The frame according to claim 2, wherein the container is provided with the flanged portion, and the flanged portion extends from the one or more side walls defining the open top, the one or more side walls and the flanged portion being formed in a single piece with each other from the third rigid material.

4. The frame according to claim 2, wherein an abutment step is formed at the rim portion so as to form a thickness reduction in (i) the frame body or (ii) the bottom wall of the container, the abutment step being configured to abut against the flanged portion.

5. The frame according to claim 1, wherein one of the at least one damping element is formed integral with the bottom wall of the container, and the first elastically deformable material and the second at least partially elastically deformable material are the same material.

6. The frame according to claim 1, wherein the damping element is formed distinct from the bottom wall and from the one or more side walls, and the first elastically deformable material is a first elastomeric polymeric material and the second at least partially elastically deformable material is (i) a viscoelastic material or (ii) a second elastomeric polymeric material.

7. The frame according to claim 1, wherein the at least one opening is a through-opening that passes through the upper surface and the lower surface of the frame body.

8. The frame according to claim 1, wherein the container has a height equal to or slightly greater than a first thickness of the frame body which separates the upper surface from the lower surface at the respective at least one opening, the at least one damping element being received inside the container so as to be operatively flush with the upper surface of the frame body.

9. The frame according to claim 1, wherein the container has a shape complementary to a shape of the respective at least one opening.

10. An equestrian saddle comprising a frame according to claim 1.

* * * * *